US006781553B2

(12) United States Patent
Iguchi et al.

(10) Patent No.: US 6,781,553 B2
(45) Date of Patent: Aug. 24, 2004

(54) ANTENNA DEVICE AND RADIO COMMUNICATION DEVICE COMPRISING THE SAME

(75) Inventors: Akihiko Iguchi, Osaka (JP); Susumu Fukushima, Osaka (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/089,736

(22) PCT Filed: Aug. 6, 2001

(86) PCT No.: PCT/JP01/06728

§ 371 (c)(1),
(2), (4) Date: Jun. 28, 2002

(87) PCT Pub. No.: WO02/13312

PCT Pub. Date: Feb. 14, 2002

(65) Prior Publication Data

US 2002/0180649 A1 Dec. 5, 2002

(30) Foreign Application Priority Data

Aug. 4, 2000 (JP) ..... 2000-237028

(51) Int. Cl.[7] ..... H01Q 21/00

(52) U.S. Cl. ..... 343/725; 343/700 MS; 343/879

(58) Field of Search ..... 343/700 MS, 702, 343/725, 879, 893, 895, 746

(56) References Cited

U.S. PATENT DOCUMENTS 5,926,139 A * 7/1999 Korisch ..... 343/702
6,211,830 B1 * 4/2001 Monma et al. ..... 343/702
6,326,921 B1 * 12/2001 Egorov et al. ..... 343/700 MS
6,343,208 B1 * 1/2002 Ying ..... 455/575.7

FOREIGN PATENT DOCUMENTS

| | | | |
|---|---|---|---|
| JP | 61-041205 | 2/1986 | |
| JP | 06-037533 | 2/1994 | |
| JP | 06-232625 | 8/1994 | |
| JP | 07-283631 | 10/1995 | |
| JP | 09-098018 | 4/1997 | |
| JP | 09-107238 | 4/1997 | |
| JP | 09-153733 | 6/1997 | |
| JP | 10-145134 | 5/1998 | |
| JP | 11-289215 | 10/1999 | |
| JP | 2000-183644 | 6/2000 | |
| JP | 2000-278028 | 10/2000 | |
| WO | WO 01/08257 A * | 2/2001 | ..... H01Q/1/38 |

OTHER PUBLICATIONS

Japanese search report for PCT/JP01/06728 dated Oct. 30, 2001.

English translation of Form PCT/ISA/210, dated Jul., 1998.

* cited by examiner

*Primary Examiner*—Shih-Chao Chen
(74) *Attorney, Agent, or Firm*—RatnerPrestia

(57) ABSTRACT

A small antenna, which is used in a mobile radio communication apparatus such as a portable telephone, operating in a broader frequency band a conventional antenna, operating corresponding to plural frequencies, and being disposed in a case is provided. The radio communication apparatus including the antenna is also provided. The antenna includes a first conductive radiator having a planer shape, a second conductive radiator having a helical shape, and a planar feeding section that is disposed between the first conductive radiator and the ground plane, is isolated from them, and supplying power by electromagnetic coupling.

39 Claims, 8 Drawing Sheets

ANTENNA DEVICE AND RADIO COMMUNICATION DEVICE COMPRISING THE SAME

THIS APPLICATION IS A U.S. NATIONAL PHASE APPLICATION OF PCT INTERNATIONAL APPLICATION PCT/JP01/06728.

FIELD OF THE INVENTION

The present invention relates to an antenna for mobile communications and to a radio communication apparatus including it.

BACKGROUND OF THE INVENTION

Mobile radio communication apparatuses such as portable telephones and pagers are recently used widespread. A mobile radio communication apparatus has a built-in antenna in a case. The mobile radio communication apparatus is a portable telephone with the built-in antenna, e.g. an inverted-F antenna generally used. The portable telephone operates as a complex terminal, thus requiring an antenna desirably transmit and receive signals in plural frequency bands.

FIG. 10 shows a conventional inverted-F antenna. The inverted-F antenna 10 includes a ground plane 11, a conductive radiator 12, a shorting section 14 for short-circuiting the ground plane 11 and the conductive radiator 12, and a feeding section 15 for supplying power to the antenna. This inverted-F antenna has an antenna characteristic of a narrow frequency band as shown in FIG. 9.

DISCLOSURE OF THE INVENTION

A small antenna used for a mobile radio communication apparatus such as portable telephone operates in a broad frequency band and corresponds to plural frequency bands.

The antenna includes a first conductive radiator having a plane shape and a second conductive radiator having a helical shape. A feeding section is made of a planar element, is disposed between the first conductive radiator having the planer shape and a ground plane, and supplies power by electromagnetic coupling, thereby providing the antenna with a broader frequency band.

DETAILED DESCRIPTION OF THE PREFERRED EMBODIMENT

Exemplary Embodiment 1

Figure 1B:
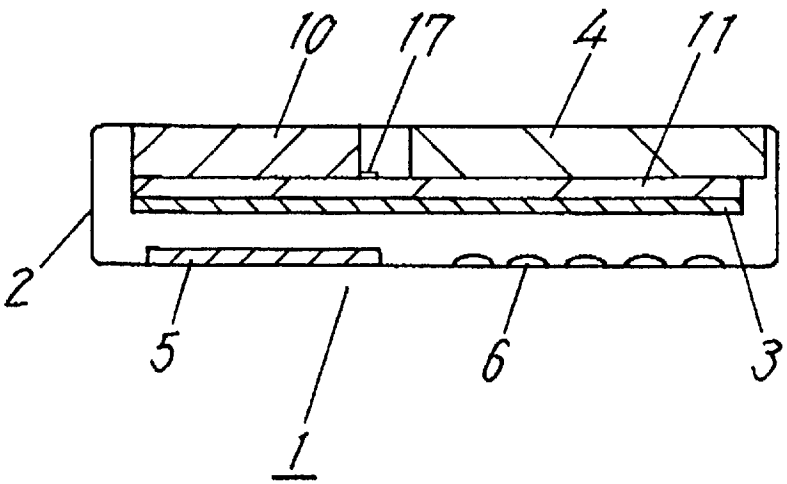
FIG. 1B is a sectional view of the portable telephone.
Figure 1A:
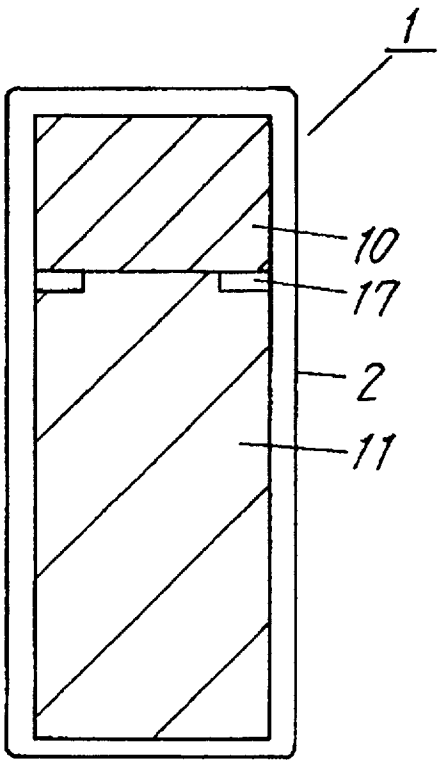
FIG. 1A is a schematic front view of a portable telephone in accordance with exemplary embodiment 1 of the present invention.

FIG. 1A is a front view of a portable telephone in accordance with exemplary embodiment 1 of the present invention. FIG. 1B is a sectional view of the portable telephone. The portable telephone 1 includes a case 2, a motherboard 3 of the portable telephone, a battery 4, a liquid crystal panel 5, an operating button 6, an antenna 10, a shield 11 of the portable telephone functioning as a ground plane, and a terminal 17 for connecting a ground plane of the antenna to the ground plane of the portable telephone.

In a structure as shown in FIG. 1A, the shield 11 on the motherboard 3 can be used as the ground plane. The antenna is disposed on the shield of the portable telephone in the present embodiment, however the antenna may be disposed directly on the motherboard with an inner ground plane (not shown) embedded in the motherboard.

Figure 3:
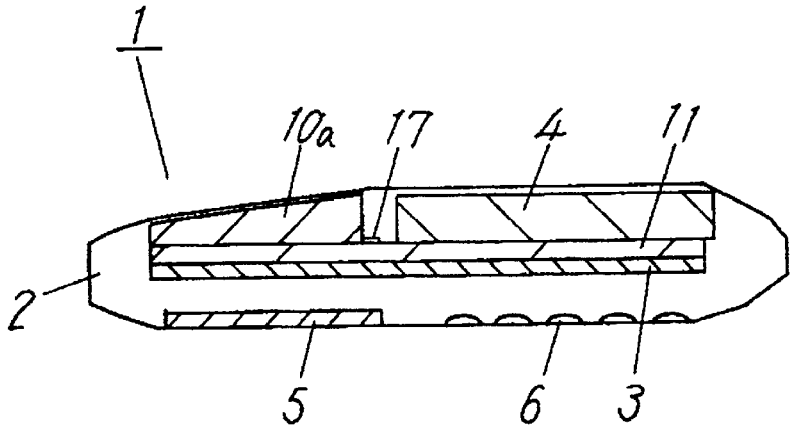
FIG. 3 is a schematic sectional view of another portable telephone in accordance with embodiment 1.

The antenna 10 has a shape which can be modified in response to a shape of the case 2 of the portable telephone 1 as shown in FIG. 3.

Figure 2B:
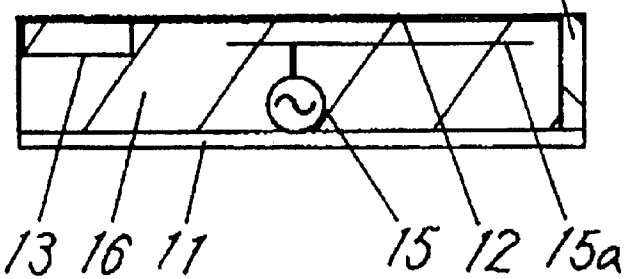
FIG. 2B is a sectional view of the antenna in accordance with embodiment 1.
Figure 2A:
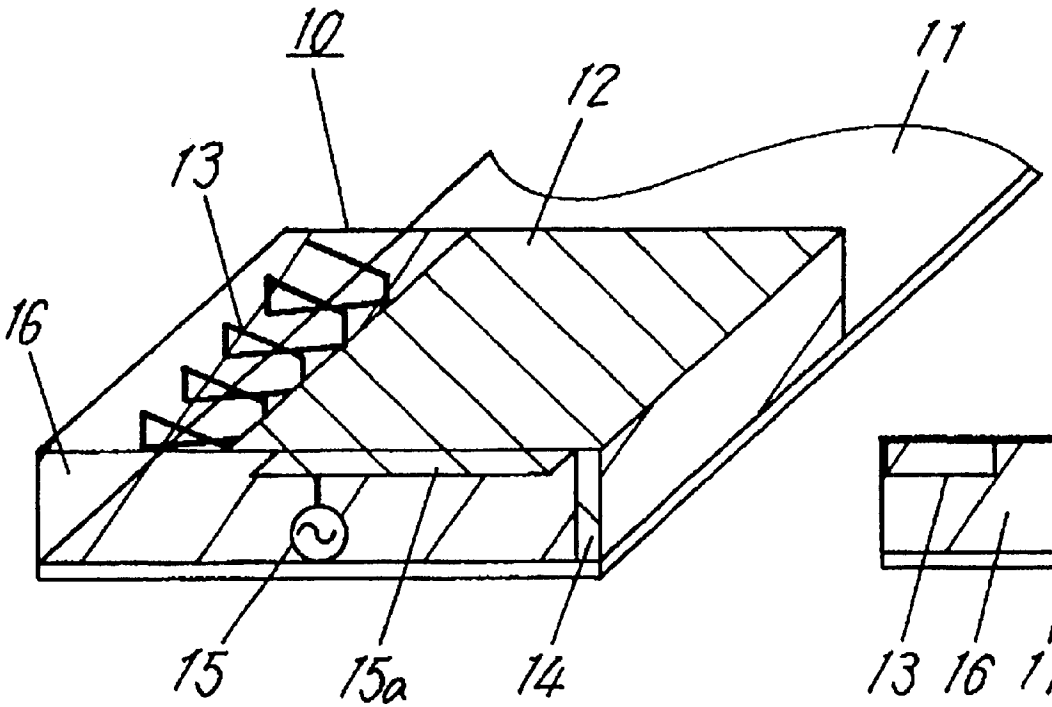
FIG. 2A is a schematic perspective view of an antenna in accordance with embodiment 1.

FIG. 2A is a perspective view of the antenna 10 in accordance with embodiment 1 of the present invention. FIG. 2B is a sectional view of the antenna. The antenna 10 includes a ground plane 11, a first conductive radiator 12 having a planer shape disposed in parallel with the ground plane, a second conductive radiator 13 having a helical shape which is disposed in parallel with the ground plane and connected to the first conductive radiator, a shorting section 14 formed above a corner of the ground plane, and a feeding section 15 which is planarly formed on a substantial center of the ground plane and insulated from the first conductive radiator and the ground plane. The first conductive radiator 12, the shorting section 14, and the feeding section 15 are formed on a dielectric spacer 16, and the second conductive radiator 13 and a feeding element 15*a* are formed in the dielectric spacer. This enables each element to be held stably with the dielectric spacer 16, and allows the antenna to be small by a wavelength shortening effect of a dielectric spacer. All of the elements may be formed in the dielectric spacer 16, or some of the elements may be formed on the spacer and other may be formed in the spacer. This also provides the antenna with a similar advantage. Therefore, a structure of the antenna is not limited to the present embodiment.

Figure 4:
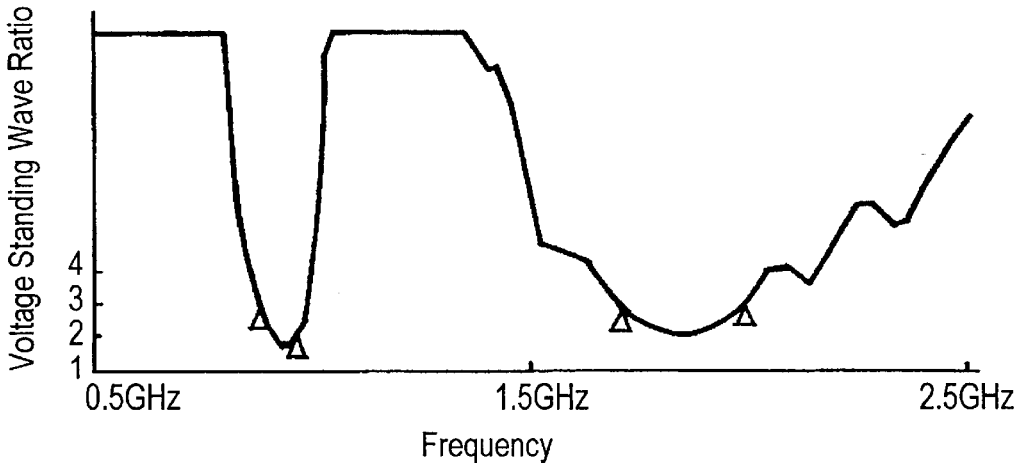
FIG. 4 is a characteristic diagram showing a relation between a frequency and a voltage standing wave ratio in accordance with embodiment 1.
Figure 9:
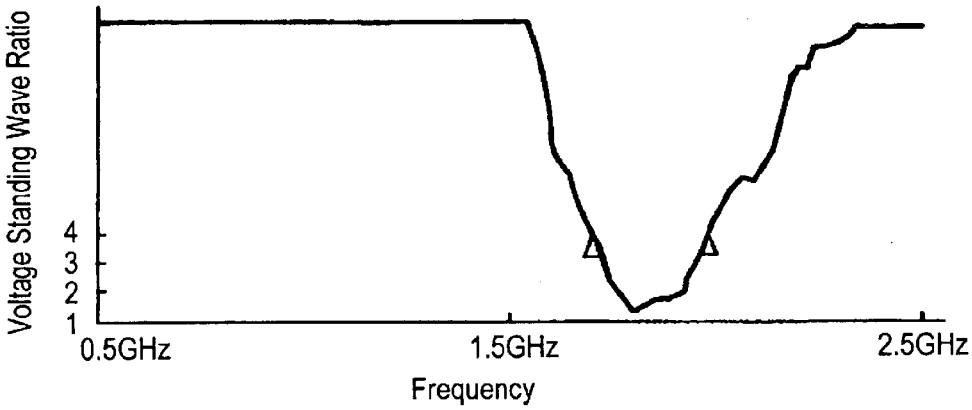
Fig. 9 Prior Art
FIG. 9 is a characteristic diagram showing a relation between a frequency and a voltage standing wave ratio of a conventional antenna.
Figure 10:
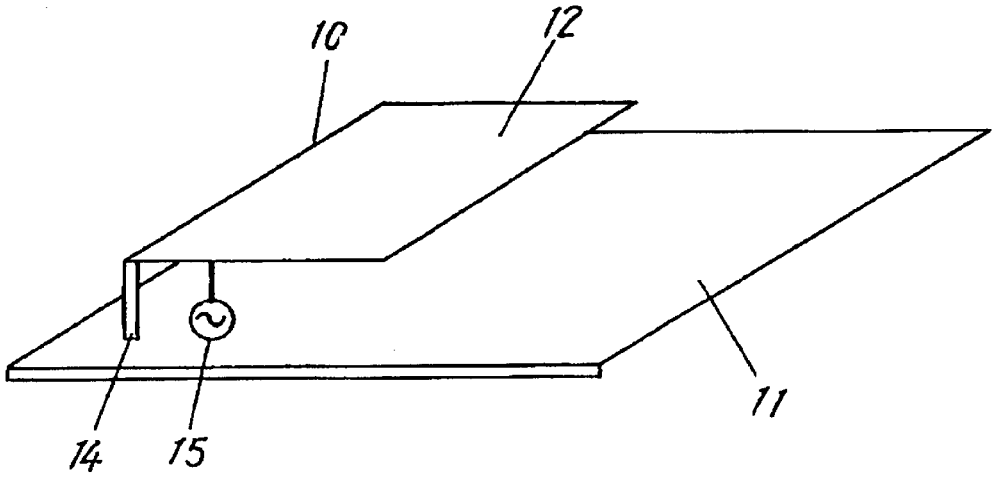
Fig. 10 Prior Art
FIG. 10 is a perspective view of the conventional antenna.

FIG. 4 shows an impedance characteristic of the antenna shown in FIG. 2A and FIG. 2B. Markers in FIG. 4 point out frequencies, 880 MHz, 960 MHz, 1710 MHz, and 1990 MHz. FIG. 9 shows an impedance characteristic of a conventional antenna shown in FIG. 10. Markers in FIG. 9 point frequencies, 1710 MHz and 1990 MHz. According to comparison between the FIG. 4 and FIG. 9, the antenna in FIG. 2A resonates in two frequency bands. That is because the first conductive radiator 12 having the planer shape and the second conductive radiator 13 having the helical shape provide different resonance frequencies. Additionally, the helical shape of the conductive radiator allows the antenna to be small.

The feeding section 15 made of the planar element is electromagnetically coupled to the conductive radiators 12 and 13. Thus, the antenna operates in broader frequency bands than an antenna with an ordinary feeding method, since having the feeding section employing the electromagnetic coupling functioning as a matching circuit.

The feeding section 15, since being disposed on a substantial center of the ground plane 11, broadening the frequency bands. That is because this disposition can substantially uniform distribution of current flowing on right and left sides of the ground plane and can eliminate a phase difference to provide the broad frequency bands.

The shorting section 14 is disposed above a corner of the ground plane 11, thereby broadening the frequency bands. That is because this disposition can align directions of currents flowing through the conductive radiators and the ground plane to an identical direction.

The connecting section between the second conductive radiator 13 having the helical shape and the first conductive radiator 12 having the planer shape is disposed oppositely to the shorting 14 with respect to the feeding section 15, thereby broadening the frequency bands. That is because this disposition allows the feeding section to match with the conductive radiators. Further, the second conductive radiator 13, since being helical, allows the antenna to be smaller a conventional antenna corresponding to two frequency bands.

The planar feeding element 15*a* has an area of 20×20=400 $mm^2$, and the first conductive radiator 12 has an area of 25×25=625 $mm^2$, namely, the ratio between them is about 2:3.

The feeding element, since having the area ratio of about 2:3 between the first conductive radiator, can suppress undesired coupling with the second conductive radiator while keeping coupling with the first conductive radiator and thus can match with the conductive radiator.

According to the present embodiment, the ground plane 11 is sized in 110×35 mm, the first conductive radiator 12 is sized in 25×25 mm, the second conductive radiator 13 is sized in 25×7×3 mm, the planar feeding section 15 is sized in 20×20 mm, and an interval between the feeding section and the first conductive radiator is 0.5 mm. FIG. 4 shows the impedance characteristic of the antenna. The antenna according to the embodiment has a size installable into the case and operates in frequency bands of 880–960 MHz and 1710–1990 MHz, thus having a desired characteristic.

The present invention is not limited to this embodiment. Each element may be optimized to provide the antenna and the portable radio communication apparatus corresponding to frequency bands such as 880–960 MHz (GSM) and 1710–1880 MHz (DCS), or frequency bands such as 880–960 MHz and 1710–2170 MHz, or frequency bands such as 824–894 MHz (AMPS) and 1850–1990 MHz (PCS).

Exemplary Embodiment 2

Figure 5A:
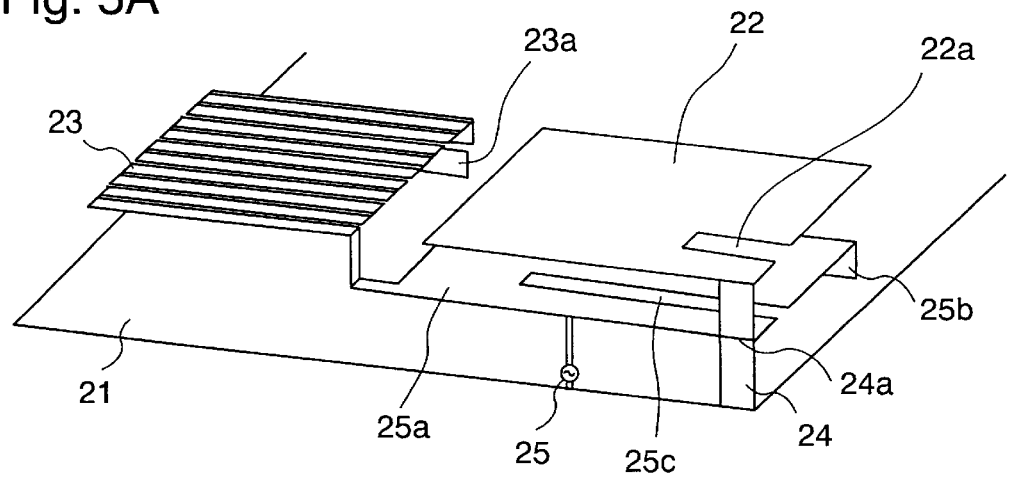
FIG. 5A is a schematic perspective view of an antenna in accordance with embodiment 2 of the invention.
Figure 5B:
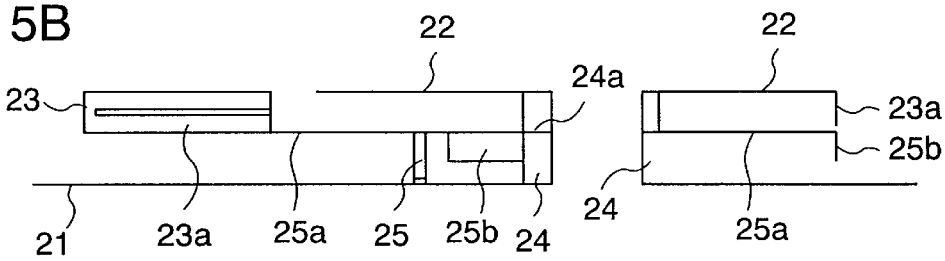
FIG. 5B is a side view of the antenna in accordance with the embodiment 2.
Figure 5C:
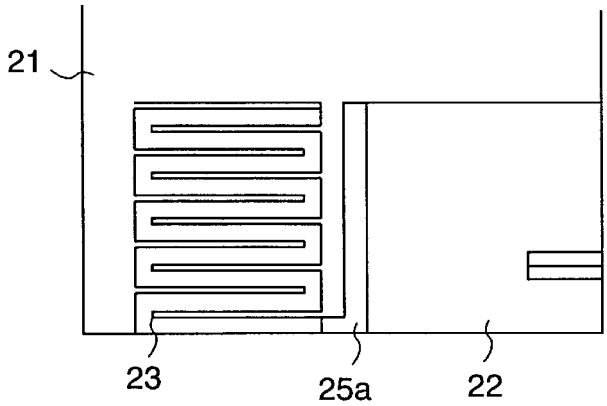
FIG. 5C is a plan view of the antenna in accordance with embodiment 2.

FIG. 5A is a schematic perspective view of an antenna in accordance with exemplary embodiment 2 of the present invention, FIG. 5B is a side view of the antenna, and FIG. 5C is a plan view of the antenna. The antenna of embodiment 2 differs from the antenna of embodiment 1 shown in FIG. 2A in a feeding element partially connected to a shorting section and in a second conductive radiator having a meander shape instead of the helical shape.

In FIG. 6A, as a ground plane 21, the shield (not shown) on a motherboard may be used similarly to the embodiment 1, or an inner ground plane (not shown) embedded in the motherboard may be used. A slit 22*a* is formed at a portion of a first conductive radiator 22 having a planer shape disposed substantially in parallel with the ground plane 21. The slit 22*a* has a position, length, or width adjusted to control an impedance of the antenna.

A second conductive radiator 23 having a meander shape disposed substantially in parallel with the ground plane 21 has a folded portion forming a folded section 23*a*. This structure allows the antenna has a substantially-extended length, thus being effective for the antenna to be small. The folded section 23*a* may be formed with a folded portion of the first conductive radiator 22, thus allowing the antenna to be small.

A shorting section 24, which short-circuits the first conductive radiator 22 and the ground plane 21, is formed at a corner of the first conductive radiator 22. A feeding section 25 is disposed substantially in parallel with the ground plane 21, and has a planar feeding element 25*a* having substantially the same longitudinal length as the first conductive radiator 22 and a slightly longer transverse length than the radiator. A portion of the feeding element 25*a* is connected to the shorting section 24 through a connecting section 24*a*, and another portion is connected to the second conductive radiator 23.

The feeding element 25*a* has a folded portion, only at a portion of one side thereof, forming a folded section 25*b*. This structure allows the antenna to have a substantially-extended length, thus allowing the antenna to be small. A slit 25*c* is formed at a portion of the feeding element 25*a*. The slit 25*c* has a position, length, or width adjusted to control an impedance of the antenna.

The slit 25*c* is longer than the slit 22*a* in the first conductive radiator 22 and faces to the slit 22*a* while slightly deviating from the slit. The antenna has an impedance adjusted depending on a positional relation between the slits.

The antenna according to the embodiment, similarly to embodiment 1, includes the above-discussed elements which may be formed on and in a dielectric spacer (not shown). For example, the first and second conductive radiators 22, 23, the shorting section 24, and the feeding section 25 may be formed on the dielectric spacer, and the feeding element 25*a* may be formed in the dielectric spacer. All the elements may be formed in the dielectric spacer. Each structure provides the antenna with a similar advantage to that of embodiment 1.

The second conductive radiator 23, the folded section 23*a*, the feeding section 25, the feeding element 25*a*, the folded section 25*b*, and the slit 25*c* may be made of a single conductive plane simply cut and folded, thus providing the antenna manufactured efficiently.

Figure 6:
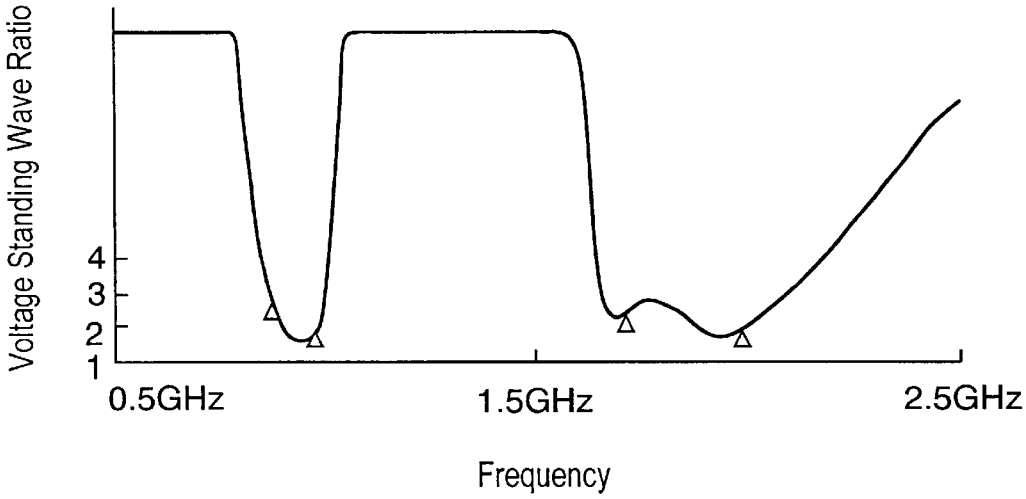
FIG. 6 is a characteristic diagram showing a relation between a frequency and a voltage standing wave ratio in accordance with embodiment 2.

FIG. 6 shows an impedance characteristic of the antenna of the present embodiment. Makers in FIG. 6 point frequencies, 880 MHz, 960 MHz, 1710 MHz, and 1990 MHz, similarly to FIG. 4. The feeding element 25*a* has a portion connected to the shorting section through the connecting section 24*a* in a structure shown in FIG. 5A, so that the antenna substantially includes two inverted-F antenna elements. Two of the inverted-F antenna elements, upon being adjusted their resonance and coupling to each other, has an impedance characteristic curve having a double-humped characteristic (characteristic having two resonance frequencies), and operates in broader frequency band.

A modified antenna of the antenna shown in FIG. 5A will be illustrated with reference to FIG. 7A.

Figure 7A:
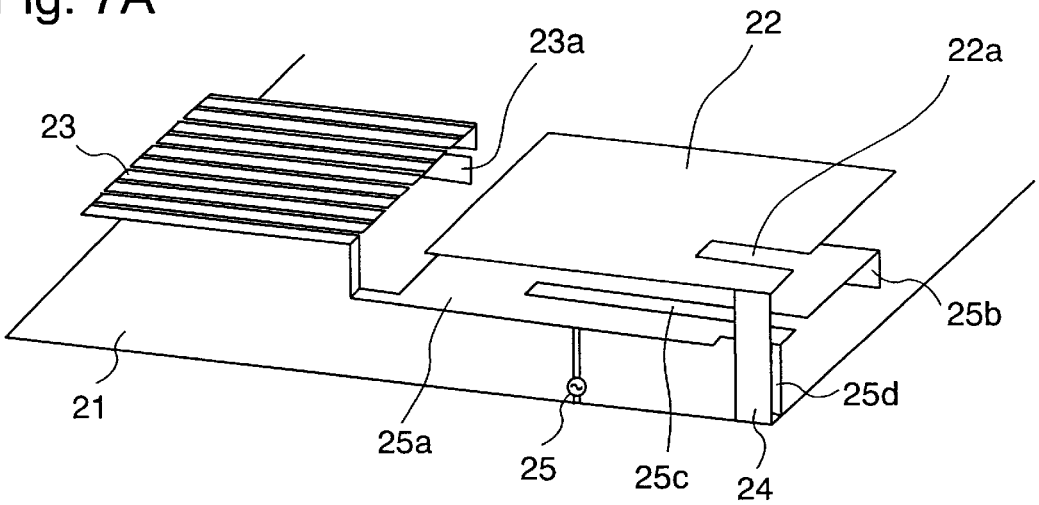
FIG. 7A is a schematic perspective view of a modified antenna in accordance with embodiment 2.
Figure 7B:
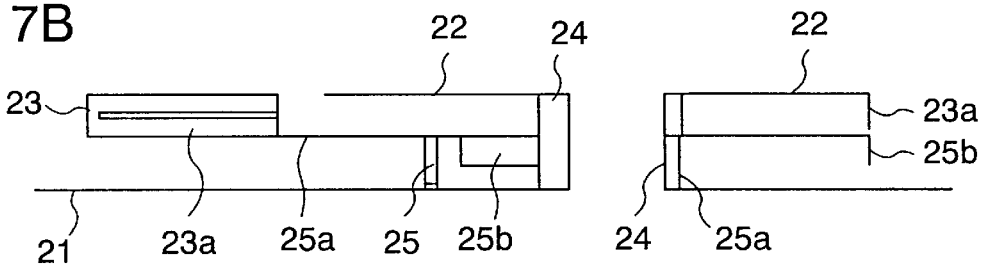
FIG. 7B is a side view of the modified antenna in accordance with embodiment 2.
Figure 7C:
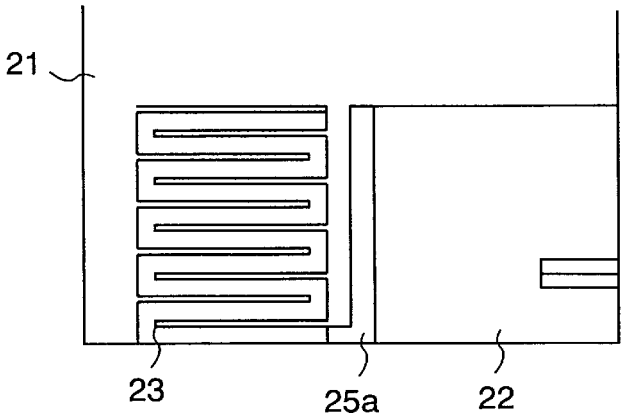
FIG. 7C is a plan view of the modified antenna in accordance with embodiment 2.

FIG. 7A is a schematic perspective view of the modified antenna in accordance with embodiment 2 of the present invention, FIG. 7B is a side view of the antenna, and FIG. 7C is a plan view of the antenna. The modified antenna differs from the antenna of embodiment 2 shown in FIG. 5A in a portion of a feeding element not being connected to a shorting section and directly connected to a ground plane. Elements similar to those in FIG. 5A are denoted by the same reference numerals, and the descriptions of these components are omitted.

In FIG. 7A, a shorting section 25*d* is disposed at a portion of a planar feeding element 25*a*. The shorting section 25*d* can be formed simply with a folded portion of the planar feeding element 25*a*, which is different from the structure in FIG. 5A, and this allows the antenna to be manufactured efficiently. In FIG. 5A, a portion of the planar feeding element 25*a* is connected to the shorting section 24 through the connecting section 24*a*. A second conductive radiator 23, the feeding section 25, the feeding element 25*a*, the folded section 25*b*, the slit 25*c*, and the shorting section 25*d* can be made of a simply-cut and folded single conductive plane, and this improves a productivity of the antenna.

Another modified antenna of the antenna shown in FIG. 5A is illustrated with reference to FIG. 8A.

Figure 8A:
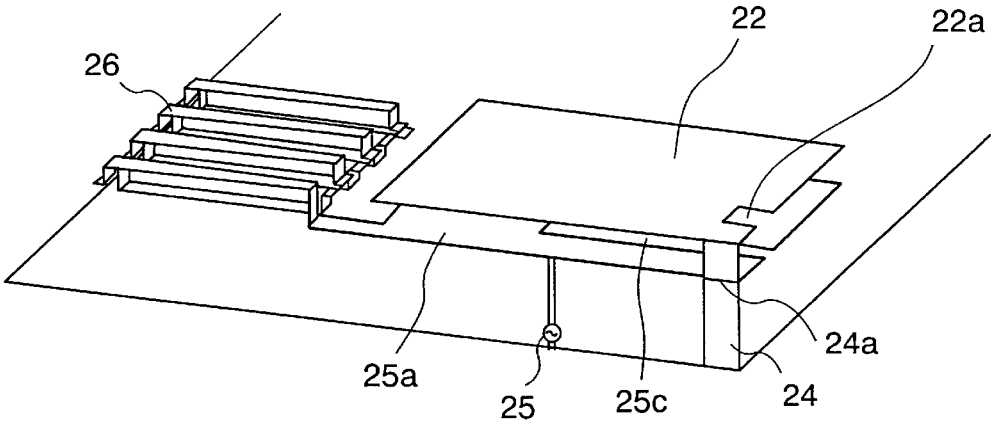
FIG. 8A is a schematic perspective view of another modified antenna in accordance with embodiment 2.
Figure 8B:
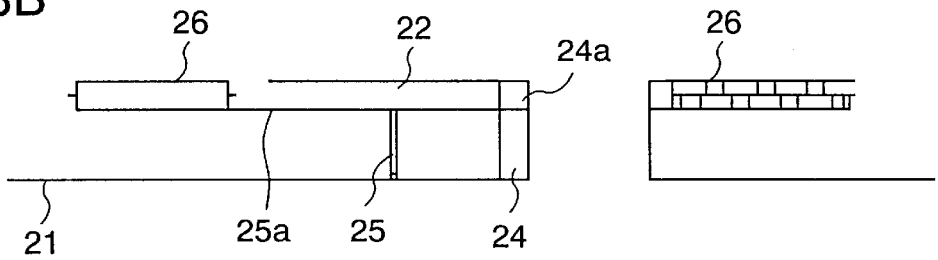
FIG. 8B is a side view of another modified antenna in accordance with embodiment 2.
Figure 8C:
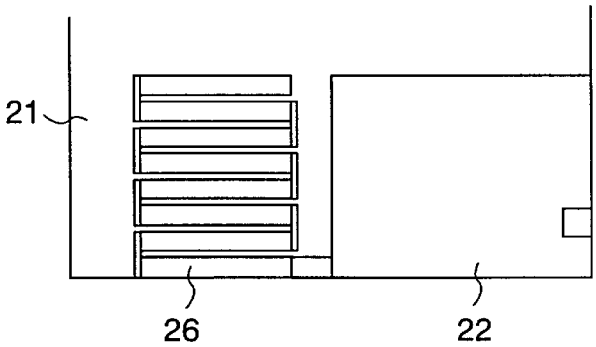
FIG. 8C is a plan view of another modified antenna in accordance with embodiment 2.

FIG. 8A is a schematic perspective view of another modified antenna in accordance with embodiment 2 of the invention, FIG. 8B is a side view of the antenna, and FIG. 8C is a plan view of the antenna. The modified antenna differs from the antenna of embodiment 2 shown in FIG. 5A in a second conductive radiator having a helical shape instead of the meander shape. Elements similar to those in FIG. 6A are denoted by the same reference numerals, and the descriptions of these elements are omitted.

In FIG. 8A, the second conductive radiator 26 is formed in the helical shape different from the meander shape of the second conductor element 23 shown in FIG. 5A. The second conductor element 26 may be made of a single cut-and-folded conductive plane in a different manner from the helical second conductive 13 shown in FIG. 1A, and this allows the conductive radiator 26 to be manufactured efficiently. The second conductive radiator 26, the feeding section 25, the feeding element 25*a*, and the slit 25*c* may be made of a single cut-and-folded conductive plane, and this improves a productivity of the antenna.

As shown in FIG. 8B and FIG. 8C, a first conductive radiator 22 and the feeding element 25*a* of the antenna in FIG. 8A have the same sizes differently from the antenna in FIG. 5A. The Slits 22*a* and 25*c* are substantially faced to each other, and the feeding element 25*a* has no folded section.

The antenna has impedance adjusted depending on existence, position, length, or width of each slit and a positional relation between the slits.

INDUSTRIAL APPLICABILITY

The present invention provides a small and broadband antenna corresponding to plural frequency bands, and a radio communication apparatus including it. A feeding section includes a planar feeding element and is provided with power by electromagnetic coupling, this provides the antenna with a broader band characteristic. Respective positions of a shorting section and the feeding element, and the size and arrangement of each element are optimized to provide the antenna with the broader band characteristic at a desired frequency.

What is claimed is:

1. An antenna comprising:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane;

a feeding section for supplying power to said first and second conductive radiators;

wherein said feeding section includes a planar feeding element, and wherein said feeding element is disposed between said first conductive radiator and said ground plane, faced to said first conductive radiator while overlapping at least partially with said first conductive radiator.

2. The antenna according to claim 1, wherein said second conductive radiator has the helical shape.

3. The antenna according to claim 1, wherein said second conductive radiator has the meander shape.

4. The antenna according to claim 1, wherein the feeding element is electrically coupled to said first conductive radiator by electromagnetic coupling.

5. The antenna according to claim 1, wherein a ratio of an area of said feeding element to an area of said first conductive radiator is substantially 2:3.

6. The antenna according to claim 1, wherein an interval between said feeding element and said first conductive radiator ranges 0.2–2 mm.

7. The antenna according to claim 1, wherein said feeding element is substantially square.

8. The antenna according to claim 7, wherein a side of said feeding element has a length ranging 10–20 mm.

9. The antenna according to claim 1, wherein said feeding element is coupled to said shorting section.

10. The antenna according to claim 1, wherein said feeding element is coupled to said ground plane.

11. The antenna according to claim 1, wherein a first slit is formed in said feeding element.

12. The antenna according to claim 11, wherein impedance is adjustable depending on a shape and a position of the first slit.

13. The antenna according to claim 11, wherein a second slit is formed in said first conductive radiator, and substantially faces to the first slit.

14. The antenna according to claim 13, wherein impedance is adjustable depending on respective shapes and positions of the first and second slits.

15. The antenna according to claim 1, wherein said feeding element includes a folded section formed by folding a portion of said feeding element.

16. The antenna according to claim 1, wherein said second conductive radiator is coupled to said first conductive radiator at an opposite side of said shorting section with respect to said feeding section.

17. The antenna according to claim 1, wherein a side of said ground plane has a length ranging 50–120 mm and other side thereof has a length ranging 20–40 mm.

18. The antenna according to claim 1, wherein said first conductive radiator is substantially square.

19. The antenna according to claim 18, wherein a side of said first conductive radiator has a length ranging 20–25 mm.

20. The antenna according to claim 1, wherein said second conductive radiator is sized in substantially 7×25×3 mm.

21. The antenna according to claim 1, wherein said first and second conductive radiator correspond to one of respective frequency bands of 880–960 MHz and 1710–1880 MHz, respective frequency bands of 880–960 MHz and 1710–1990 MHz, respective frequency bands of 880–960 MHz and 1710–2170 MHz, and respective frequency bands of 824–894 MHz and 1850–1990 MHz.

22. The antenna according to claim 1, further comprising a dielectric spacer including said first and second conductive radiators, said shorting section, and said feeding section thereon or therein.

23. The antenna according to claim 1, wherein a slit is formed in said first conductive radiator.

24. The antenna according to claim 1, wherein impedance is adjustable depending on a shape and a position of the slit.

25. An antenna comprising:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane;

a feeding section for supplying power to said first and second conductive radiators;

wherein said feeding section includes a planar feeding element, and wherein said feeding element is electrically coupled to said first conductive radiator by electromagnetic coupling.

26. An antenna comprising:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane;

a feeding section for supplying power to said first and second conductive radiators;

wherein said first conductive radiator includes a folded section formed by folding a portion of said first conductive radiator.

27. An antenna comprising:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane;

a feeding section for supplying power to said first and second conductive radiators;

wherein said second conductor radiator is formed in a meander shape, and includes a folded section formed by folding a portion of said second conductive radiator.

28. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a motherboard coupling with said ground plane and said first and second conductive radiators, wherein said first and second conductive radiators and said ground plane are unitarily formed, wherein said feeding section includes a planar feeding element, and wherein said feeding element is disposed between said first conductive radiator and said ground plane, faced to said first conductive radiator while overlapping at least partially with said first conductive radiator.

29. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case accommodating said antenna, wherein said shorting section is disposed over a corner of said ground plane, wherein said feeding section includes a planar feeding element, and wherein said feeding element is disposed between said first conductive radiator and said ground plane, faced to said first conductive radiator while overlapping at least partially with said first conductive radiator.

30. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case for accommodating said antenna, wherein said feeding section is disposed over a substantial center of said ground plane;

wherein said feeding section includes a planar feeding element, and wherein said feeding element is disposed between said first conductive radiator and said ground plane, faced to said first conductive radiator while overlapping at least partially with said first conductive radiator.

31. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a motherboard coupling with said ground plane and said first and second conductive radiators, wherein said first and second conductive radiators and said ground plane are unitarily formed, wherein said feeding section includes a planar feeding element, and wherein said feeding element is electrically coupled to said first conductive radiator by electromagnetic coupling.

32. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case accommodating said antenna, wherein said shorting section is disposed over a corner of said ground plane, wherein said feeding section includes a planar feeding element, and wherein said feeding element is electrically coupled to said first conductive radiator by electromagnetic coupling.

33. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case for accommodating said antenna, wherein said feeding section is disposed over a substantial center of said ground plane;

wherein said feeding section includes a planar feeding element, and wherein said feeding element is electrically coupled to said first conductive radiator by electromagnetic coupling.

34. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a motherboard coupling with said ground plane and said first and second conductive radiators, wherein said first and second conductive radiators and said ground plane are unitarily formed, wherein said first conductive radiator includes a folded section formed by folding a portion of said first conductive radiator.

35. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case accommodating said antenna, wherein said shorting section is disposed over a corner of said ground plane, wherein said first conductive radiator includes a folded section formed by folding a portion of said first conductive radiator.

36. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case for accommodating said antenna, wherein said feeding section is disposed over a substantial center of said ground plane, wherein said first conductive radiator includes a folded section formed by folding a portion of said first conductive radiator.

37. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a motherboard coupling with said ground plane and said first and second conductive radiators, wherein said first and second conductive radiators and said ground plane are unitarily formed, wherein said second conductor radiator is formed in a meander shape, and includes a folded section formed by folding a portion of said second conductive radiator.

38. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case accommodating said antenna, wherein said shorting section is disposed over a corner of said ground plane, wherein said second conductor radiator is formed in a meander shape, and includes a folded section formed by folding a portion of said second conductive radiator.

39. A radio communication apparatus comprising:

an antenna including:

a ground plane;

a first conductive radiator having a planer shape disposed substantially in parallel with said ground plane;

a second conductive radiator having one of a helical shape and a meander shape disposed substantially in parallel with said ground plane, said second conductive radiator being coupled to a portion of said first conductive radiator;

a shorting section for coupling said first conductive radiator to said ground plane; and a feeding section for supplying power to said first and second conductive radiators; and a case for accommodating said antenna, wherein said feeding section is disposed over a substantial center of said ground plane, wherein said second conductor radiator is formed in a meander shape, and includes a folded section formed by folding a portion of said second conductive radiator.

* * * * *